US008295741B2

(12) United States Patent
Kido

(10) Patent No.: US 8,295,741 B2
(45) Date of Patent: Oct. 23, 2012

(54) DEVELOPING APPARATUS AND IMAGE FORMING APPARATUS

(75) Inventor: Hiroto Kido, Setagaya-ku (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 289 days.

(21) Appl. No.: 12/728,896

(22) Filed: Mar. 22, 2010

(65) Prior Publication Data

US 2010/0239322 A1 Sep. 23, 2010

(30) Foreign Application Priority Data

Mar. 23, 2009 (JP) ..... 2009-069767

(51) Int. Cl.
*G03G 15/08* (2006.01)

(52) U.S. Cl. ..... 399/260; 399/222; 399/254; 399/258

(58) Field of Classification Search ..... 399/222, 399/254, 258, 260, 274, 284
See application file for complete search history.

(56) References Cited

U.S. PATENT DOCUMENTS

| | | | | |
|---|---|---|---|---|
| 2003/0147661 | A1* | 8/2003 | Ogata | 399/58 |
| 2004/0037575 | A1* | 2/2004 | Ishida | 399/27 |
| 2006/0165440 | A1* | 7/2006 | Adachi | 399/254 |
| 2007/0104515 | A1* | 5/2007 | Akedo | 399/254 |

FOREIGN PATENT DOCUMENTS

| | | | |
|---|---|---|---|
| JP | 06-242683 | | 9/1994 |
| JP | 6-250517 | A | 9/1994 |
| JP | 06242683 | A * | 9/1994 |
| JP | 6-332313 | A | 12/1994 |
| JP | 10-186829 | | 7/1998 |
| JP | 3014563 | B2 | 2/2000 |
| JP | 2006-293214 | | 10/2006 |
| JP | 2006-323238 | | 11/2006 |
| JP | 2006323238 | A * | 11/2006 |

OTHER PUBLICATIONS

Office Action (Notification of Reason for Refusal) dated Feb. 8, 2011, issued in the corresponding Japanese Patent Application No. 2009-069767, and an English Translation thereof.

* cited by examiner

*Primary Examiner* — David Gray
*Assistant Examiner* — Francis Gray
(74) *Attorney, Agent, or Firm* — Buchanan Ingersoll & Rooney PC

(57) ABSTRACT

A developer accommodating container is structured such as to be provided with a first accommodating portion in which the first feeding member is arranged, a second accommodating portion in which the second feeding member is arranged, a first communication portion communicating the first accommodating portion and the second accommodating portion in one end side, a second communication portion communicating the first accommodating portion and the second accommodating portion at the other end side, a developer replenishing portion arranged in the other end side rather than the second communication portion, in the other end side of the first accommodating portion, a developer discharge portion arranged in the other end side rather than the second communication portion, in the other end side of the second accommodating portion, and a flow rate regulating portion arranged between the second communication portion and the developer discharge portion, and regulating an amount of the passing developer.

11 Claims, 10 Drawing Sheets

Fig. 11

| AMPLITUDE OF DETECTED WAVE FORM (DETECTED VALUE IN STATES 1 AND 2: V) | DETECTED TONER DENSITY (DETECTED VALUE IN STATE 1) | | | | | | |
|---|---|---|---|---|---|---|---|
| | 5 | 5.5 | 6 | 6.5 | 7 | 7.5 | 8 |
| 3 | APPROPRIATE | WEIGHT SMALL 1 | WEIGHT SMALL 1 | WEIGHT SMALL 2 | WEIGHT SMALL 2 | WEIGHT SMALL 2 | WEIGHT SMALL 2 |
| 2.8 | APPROPRIATE | WEIGHT SMALL 1 | WEIGHT SMALL 1 | WEIGHT SMALL 2 | WEIGHT SMALL 2 | WEIGHT SMALL 2 | WEIGHT SMALL 2 |
| 2.6 | APPROPRIATE | WEIGHT SMALL 1 | WEIGHT SMALL 1 | WEIGHT SMALL 1 | WEIGHT SMALL 2 | WEIGHT SMALL 2 | WEIGHT SMALL 2 |
| 2.4 | APPROPRIATE | WEIGHT SMALL 1 | WEIGHT SMALL 1 | WEIGHT SMALL 1 | WEIGHT SMALL 2 | WEIGHT SMALL 2 | WEIGHT SMALL 2 |
| 2.2 | APPROPRIATE | WEIGHT SMALL 1 | WEIGHT SMALL 1 | WEIGHT SMALL 1 | WEIGHT SMALL 2 | WEIGHT SMALL 2 | WEIGHT SMALL 2 |
| 2 | APPROPRIATE | APPROPRIATE | WEIGHT SMALL 1 | WEIGHT SMALL 1 | WEIGHT SMALL 2 | WEIGHT SMALL 2 | WEIGHT SMALL 2 |
| 1.8 | APPROPRIATE | APPROPRIATE | WEIGHT SMALL 1 | WEIGHT SMALL 1 | WEIGHT SMALL 1 | WEIGHT SMALL 2 | WEIGHT SMALL 2 |
| 1.6 | WEIGHT LARGE 1 | APPROPRIATE | APPROPRIATE | WEIGHT SMALL 1 | WEIGHT SMALL 1 | WEIGHT SMALL 1 | WEIGHT SMALL 2 |
| 1.4 | WEIGHT LARGE 1 | APPROPRIATE | APPROPRIATE | APPROPRIATE | WEIGHT SMALL 1 | WEIGHT SMALL 1 | WEIGHT SMALL 1 |
| 1.2 | WEIGHT LARGE 1 | WEIGHT LARGE 1 | APPROPRIATE | APPROPRIATE | WEIGHT SMALL 1 | WEIGHT SMALL 1 | WEIGHT SMALL 1 |
| 1 | WEIGHT LARGE 1 | WEIGHT LARGE 1 | APPROPRIATE | APPROPRIATE | APPROPRIATE | WEIGHT SMALL 1 | WEIGHT SMALL 1 |
| 0.8 | WEIGHT LARGE 1 | WEIGHT LARGE 1 | WEIGHT LARGE 1 | APPROPRIATE | APPROPRIATE | APPROPRIATE | WEIGHT SMALL 1 |
| 0.6 | WEIGHT LARGE 2 | WEIGHT LARGE 1 | WEIGHT LARGE 1 | WEIGHT LARGE 1 | APPROPRIATE | APPROPRIATE | APPROPRIATE |
| 0.4 | WEIGHT LARGE 2 | WEIGHT LARGE 2 | WEIGHT LARGE 1 | WEIGHT LARGE 1 | WEIGHT LARGE 1 | APPROPRIATE | APPROPRIATE |
| 0.2 | WEIGHT LARGE 2 | WEIGHT LARGE 2 | WEIGHT LARGE 2 | WEIGHT LARGE 1 | WEIGHT LARGE 1 | WEIGHT LARGE 1 | WEIGHT LARGE 1 |

Fig. 12

| | | DETECTED TONER DENSITY (DETECTED VALUE IN STATE 1: wt %) | | | | | | |
|---|---|---|---|---|---|---|---|---|
| | | 5 | 5.5 | 6 | 6.5 | 7 | 7.5 | 8 |
| DETECTED WAVE FORM CYCLE FLUCTUATION RATIO | -2 | WEIGHT SMALL 2 | WEIGHT SMALL 2 | WEIGHT SMALL 2 | WEIGHT SMALL 2 | WEIGHT SMALL 2 | WEIGHT SMALL 2 | WEIGHT SMALL 2 |
| | -1.8 | WEIGHT SMALL 2 | WEIGHT SMALL 2 | WEIGHT SMALL 2 | WEIGHT SMALL 2 | WEIGHT SMALL 2 | WEIGHT SMALL 2 | WEIGHT SMALL 2 |
| | -1.6 | WEIGHT SMALL 2 | WEIGHT SMALL 2 | WEIGHT SMALL 2 | WEIGHT SMALL 2 | WEIGHT SMALL 2 | WEIGHT SMALL 1 | WEIGHT SMALL 1 |
| | -1.4 | WEIGHT SMALL 2 | WEIGHT SMALL 2 | WEIGHT SMALL 2 | WEIGHT SMALL 1 | WEIGHT SMALL 1 | WEIGHT SMALL 1 | WEIGHT SMALL 1 |
| | -1.2 | WEIGHT SMALL 2 | WEIGHT SMALL 1 | WEIGHT SMALL 1 | WEIGHT SMALL 1 | WEIGHT SMALL 1 | WEIGHT SMALL 1 | WEIGHT SMALL 1 |
| | -1 | WEIGHT SMALL 1 | WEIGHT SMALL 1 | WEIGHT SMALL 1 | WEIGHT SMALL 1 | WEIGHT SMALL 1 | WEIGHT SMALL 1 | WEIGHT SMALL 1 |
| | -0.8 | WEIGHT SMALL 1 | WEIGHT SMALL 1 | WEIGHT SMALL 1 | WEIGHT SMALL 1 | WEIGHT SMALL 1 | WEIGHT SMALL 1 | WEIGHT SMALL 1 |
| | -0.6 | WEIGHT SMALL 1 | WEIGHT SMALL 1 | WEIGHT SMALL 1 | WEIGHT SMALL 1 | WEIGHT SMALL 1 | APPROPRIATE | APPROPRIATE |
| | -0.4 | WEIGHT SMALL 1 | WEIGHT SMALL 1 | WEIGHT SMALL 1 | APPROPRIATE | APPROPRIATE | APPROPRIATE | APPROPRIATE |
| | -0.2 | WEIGHT SMALL 1 | APPROPRIATE | APPROPRIATE | APPROPRIATE | APPROPRIATE | APPROPRIATE | APPROPRIATE |
| | 0 | APPROPRIATE | APPROPRIATE | APPROPRIATE | APPROPRIATE | APPROPRIATE | APPROPRIATE | APPROPRIATE |
| | 0.2 | APPROPRIATE | APPROPRIATE | APPROPRIATE | APPROPRIATE | APPROPRIATE | APPROPRIATE | APPROPRIATE |
| | 0.4 | APPROPRIATE | APPROPRIATE | APPROPRIATE | APPROPRIATE | APPROPRIATE | APPROPRIATE | WEIGHT LARGE 1 |
| | 0.6 | APPROPRIATE | APPROPRIATE | APPROPRIATE | APPROPRIATE | WEIGHT LARGE 1 | WEIGHT LARGE 1 | WEIGHT LARGE 1 |
| | 0.8 | APPROPRIATE | APPROPRIATE | WEIGHT LARGE 1 | WEIGHT LARGE 1 | WEIGHT LARGE 1 | WEIGHT LARGE 1 | WEIGHT LARGE 1 |
| | 1 | WEIGHT LARGE 1 | WEIGHT LARGE 1 | WEIGHT LARGE 1 | WEIGHT LARGE 1 | WEIGHT LARGE 1 | WEIGHT LARGE 1 | WEIGHT LARGE 1 |
| | 1.2 | WEIGHT LARGE 1 | WEIGHT LARGE 1 | WEIGHT LARGE 1 | WEIGHT LARGE 1 | WEIGHT LARGE 1 | WEIGHT LARGE 1 | WEIGHT LARGE 1 |
| | 1.4 | WEIGHT LARGE 1 | WEIGHT LARGE 1 | WEIGHT LARGE 1 | WEIGHT LARGE 1 | WEIGHT LARGE 1 | WEIGHT LARGE 1 | WEIGHT LARGE 2 |
| | 1.6 | WEIGHT LARGE 1 | WEIGHT LARGE 1 | WEIGHT LARGE 1 | WEIGHT LARGE 1 | WEIGHT LARGE 2 | WEIGHT LARGE 2 | WEIGHT LARGE 2 |
| | 1.8 | WEIGHT LARGE 1 | WEIGHT LARGE 1 | WEIGHT LARGE 2 | WEIGHT LARGE 2 | WEIGHT LARGE 2 | WEIGHT LARGE 2 | WEIGHT LARGE 2 |
| | 2 | WEIGHT LARGE 2 | WEIGHT LARGE 2 | WEIGHT LARGE 2 | WEIGHT LARGE 2 | WEIGHT LARGE 2 | WEIGHT LARGE 2 | WEIGHT LARGE 2 |

Fig. 13

| PRESSURE SENSOR OUTPUT (V) | |
|---|---|
| 1.15 | WEIGHT SMALL 2 |
| 1.3 | WEIGHT SMALL 2 |
| 1.45 | WEIGHT SMALL 2 |
| 1.6 | WEIGHT SMALL 1 |
| 1.75 | WEIGHT SMALL 1 |
| 1.9 | WEIGHT SMALL 1 |
| 2.05 | WEIGHT SMALL 1 |
| 2.2 | WEIGHT SMALL 1 |
| 2.35 | APPROPRIATE |
| 2.5 | APPROPRIATE |
| 2.65 | APPROPRIATE |
| 2.8 | APPROPRIATE |
| 2.95 | APPROPRIATE |
| 3.1 | APPROPRIATE |
| 3.25 | WEIGHT LARGE 1 |
| 3.4 | WEIGHT LARGE 1 |
| 3.55 | WEIGHT LARGE 1 |
| 3.7 | WEIGHT LARGE 1 |
| 3.85 | WEIGHT LARGE 1 |
| 4 | WEIGHT LARGE 2 |
| 4.15 | WEIGHT LARGE 2 |

DEVELOPING APPARATUS AND IMAGE FORMING APPARATUS

This application is based on Japanese Patent Application No. 2009-069767 filed in Japan on Mar. 23, 2009, the entire content of which is hereby incorporated by reference.

BACKGROUND OF THE INVENTION

1. Field of the Invention

The present invention relates to a developing apparatus and an image forming apparatus.

2. Description of the Related Art

Conventionally, in a so-called trickle type image forming apparatus structured such as to discharge a developer including a deteriorated carrier, and replenish a new developer, for example, a structure having the following structured developing apparatus is known.

In other words, there is known a developing apparatus structured such as to inhibit a lot of developers from being discharged all at once from a developing tank on the basis of a protruding portion, even if the developing tank is inclined, by forming the protruding portion allowing the developer to flow into the developing tank, and forming a discharge opening in a wall portion of the protruding portion (for example, refer to Japanese Patent No. 3014563).

Further, there is known the other developing apparatus structured such as to discharge a developer at an amount which is comparable to a replenishing amount by opening and closing a discharge opening formed in a developing tank by means of an opening and closing lid by driving a solenoid for discharging (for example, refer to Japanese Unexamined Patent Publication No. 6-250517).

SUMMARY OF THE INVENTION

However, in any developing apparatus mentioned above, it is hard to set a discharge amount of the developer to an appropriate value.

In other words, in the developing apparatus described in the Japanese Patent No. 3014563, it is only possible to prevent the developer from running into the discharge opening all at once by the protruding portion. Since it is necessary not only to suppress the discharge amount of the developer, but also to promote it, it is impossible to obtain an appropriate discharge amount only by suppressing by means of the protruding portion.

On the other hand, in the developing apparatus described in the Japanese Unexamined Patent Publication No. 6-250517, the discharge opening is only opened and closed by the opening and closing lid. A liquid surface of the developer is displaced in accordance with a position within the developing apparatus, on the basis of a variation of an inclination of the developing apparatus and a system speed (a rotating speed of a photoreceptor, a sheet feeding speed or the like), however, it is impossible to sufficiently correspond to the displacement of the liquid surface only by opening and closing the discharge opening. In other words, it is impossible to appropriately regulate a discharge amount of the developer.

Accordingly, an object of the present invention is to provide a developing apparatus and an image forming apparatus which can appropriately regulate a discharge amount of a developer.

In accordance with one aspect of the present invention, there is provided a developing apparatus including:

a developer carrying member;

a developer accommodating container extending from one end to the other end along the developer carrying member, and in which the developer is accommodated;

a first feeding member provided within the developer accommodating container and feeding the accommodated developer while agitating; and a second feeding member provided within the developer accommodating container and feeding the developer to the developer carrying member, wherein the developer accommodating container includes:

a first accommodating portion in which the first feeding member is arranged;

a second accommodating portion in which the second feeding member is arranged;

a first communication portion communicating the first accommodating portion and the second accommodating portion in one end side;

a second communication portion communicating the first accommodating portion and the second accommodating portion at the other end side;

a developer replenishing portion arranged in the other end side rather than the second communication portion, in the other end side of the first accommodating portion;

a developer discharge portion arranged in the other end side rather than the second communication portion, in the other end side of the second accommodating portion; and a flow rate regulating portion arranged between the second communication portion and the developer discharge portion, and regulating an amount of the passing developer.

In accordance with this structure, it is possible to stabilize the liquid surface position by regulating the amount of the developer heading for the developer discharge portion by the flow rate regulating portion. Accordingly, in comparison with the case that the discharge amount of the developer is regulated directly by the developer discharge portion, it is possible to appropriately regulate the discharge amount of the developer.

In the above aspect, the flow rate regulating portion is constructed by a magnetic material capable of picking up the developer which is magnetized by a current application so as to intend to pass through.

In the above aspect, the flow rate regulating portion regulates an amount of the developer passing through by making a cross sectional area of a flow path changeable.

In the above aspect, the developing apparatus further includes:

a developer weight presuming means for presuming a weight of the developer within the developer accommodating container; and a flow rate control means for regulating an amount of the passing developer by controlling to drive the flow rate regulating portion on the basis of the weight of the developer presumed by the developer weight presuming means.

In accordance with this structure, it is possible to set the amount of the developer discharged via the developer discharge portion to a more appropriate value. In other words, in the case that the presumed weight of the developer goes beyond the previously set reference value, it is possible to rapidly regulate the weight of the developer circulating within the developer accommodating container to the reference value by increasing the amount of the developer which is put through by the flow rate regulating portion. Further, in the case that the presumed weight of the developer is less than the previously set reference value, it is possible to suppress the amount of the developer discharged via the developer discharge portion, by reducing the amount of the developer which can pass through by the flow rate regulating portion.

In the above aspect, the second feeding member is provided with a spiral blade portion in the periphery of the rotating shaft, wherein the blade portion includes:

a first blade portion feeding the developer from the first communication portion side to the second communication portion side while agitating on the basis of a rotation;

a second blade portion applying an inverted resistance to the developer fed by the first blade portion; and a third blade portion leading the developer getting over the second blade portion to the developer discharge portion, and wherein the flow rate regulating portion is capable of expanding and contracting an opening region between an inner wall side constructing the second accommodating portion and the periphery of the rotating shaft of the second feeding member where the blade portion is not positioned.

In accordance with this structure, if the opening region is reduced to the periphery of the rotating shaft by the flow rate regulating portion, the developer which can pass through the flow rate regulating portion hardly exists, and it is possible to set the amount of the developer discharged via the developer discharge portion to approximately 0.

Further, in accordance with the present invention, there is provided an image forming apparatus which is provided with the developing apparatus described in any one of the aspects mentioned above, as a means for solving the problem mentioned above.

In accordance with the present invention, it is possible to regulate the passing amount of the developer in the stage before running into the developer discharge portion by the flow rate regulating portion. Accordingly, it is possible to securely set the discharge amount of the developer in the developer discharge portion to the desired value.

BRIEF DESCRIPTION OF THE DRAWINGS

FIG. 11 is a data table for presuming a weight of a developer within a developer accommodating container on the basis of an amplitude of a signal wave form detected by the toner density sensor and the toner density;

FIG. 12 is a data table for presuming the weight of the developer within the developer accommodating container on the basis of a fluctuation ratio of the signal wave form detected by the toner density sensor and the toner density; and FIG. 13 is a data table for presuming the weight of the developer within the developer accommodating container on the basis of a result of detection by a pressure sensor.

DETAILED DESCRIPTION OF THE PREFERRED EMBODIMENTS

A description will be given below of an embodiment in accordance with the present invention with reference to the accompanying drawings. It is noted that terms (for example, terms including "upper", "lower", "side" and "end") indicating specific directions and positions are used as occasion demands in the following description, however, these terms are used for facilitating the understanding of the invention with reference to the drawings, and a technical range of the present invention is not limited by the meanings of the terms.

1. Whole Construction

Figure 1:
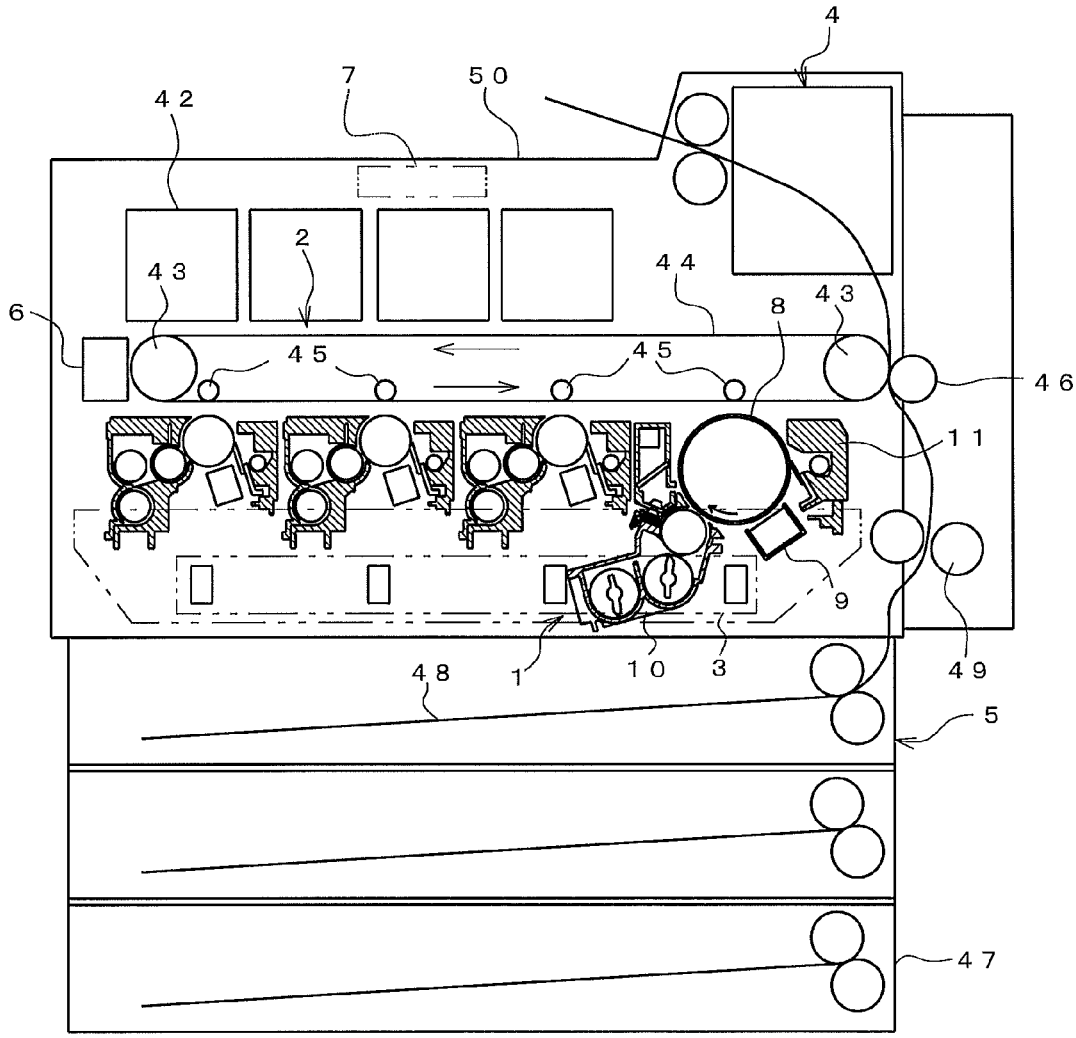
FIG. 1 is a front elevational view showing an outline of an image forming apparatus in accordance with the present embodiment.

FIG. 1 shows a so-called trickle type image forming apparatus, particularly structured such as to replenish a developer in addition to a toner, in an electronic photography system using a two-component developer. The image forming apparatus is generally provided with an image forming unit 1, a transfer unit 2, an exposure unit 3, a fixing unit 4, a paper feeding unit 5, a cleaning unit 6, a control unit 7 (refer to FIG. 5) and the like. It is noted that the image forming apparatus may be constructed by any of a copy machine, a printer, a facsimile, and a complex machine complexly provided with these functions.

1-1. Image Forming Unit 1

The image forming units 1 are arranged at four positions along an intermediate transfer belt 44 of the transfer unit 2, and form a color image on a surface of the intermediate transfer belt 44 by respectively carrying out an image formation of yellow (Y), magenta (M), cyan (C) and black (Bk) from a left side in FIG. 1. Each of the image forming units 1 is provided with a charging apparatus 9, a developing apparatus 10, a cleaning apparatus 11 and the like around a photoreceptor drum 8, as shown in FIG. 2.

The charging apparatus 9 forms a predetermined surface potential on a surface of the photoreceptor drum 8. The surface potential comes to an electrostatic latent image by being exposed by the exposure unit 3. In this case, a non-contact type scorotron charger is used as the charging apparatus 9, however, it is possible to use, for example, a contact type such as a blade-shaped, a brush-shaped, and the like, and it is possible to use a charging roller.

Figure 2:
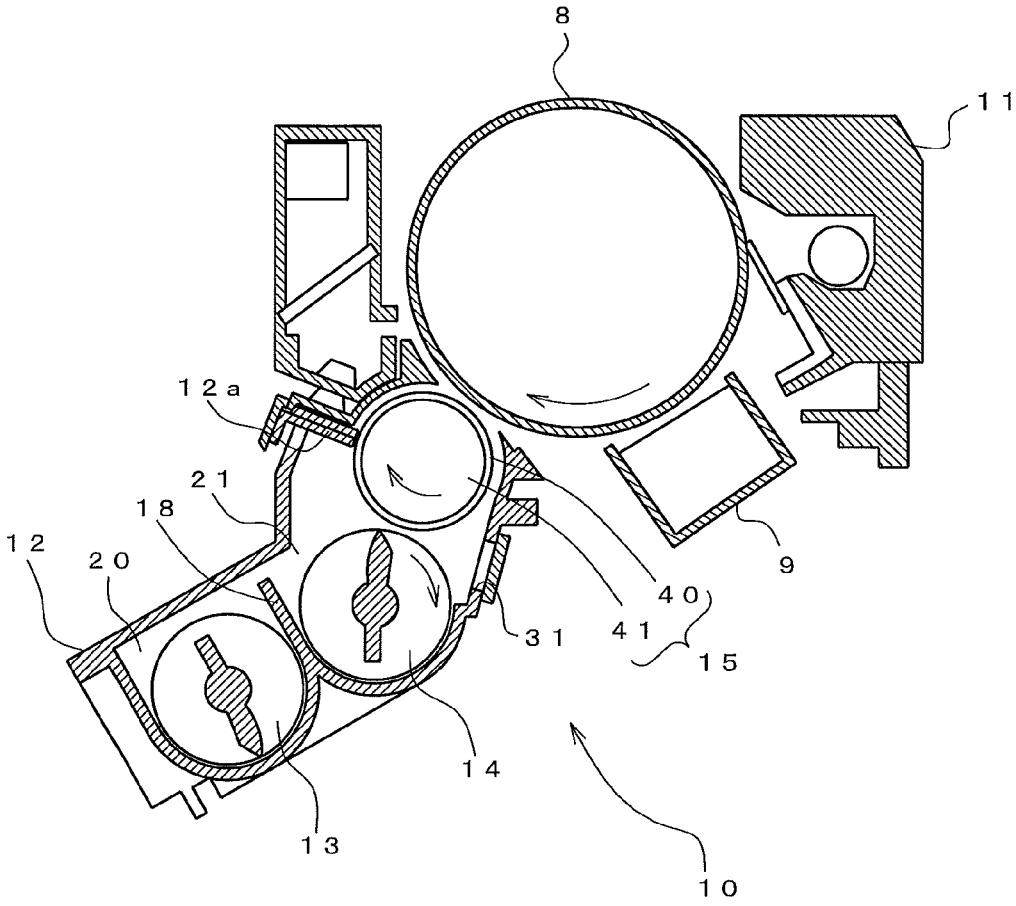
FIG. 2 is a front cross sectional view showing an outline of an image forming unit in FIG. 1.
Figure 3:
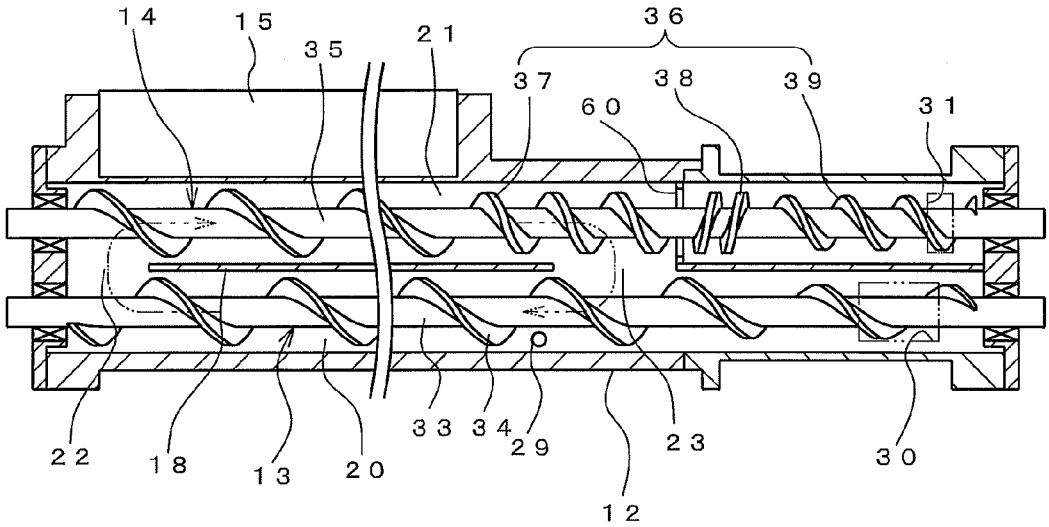
FIG. 3 is a plan cross sectional view showing an outline of a developing apparatus in FIG. 2.

The developing apparatus 10 is structured, as shown in FIGS. 2 and 3, such that each of an agitating screw 13, a feeding screw 14 and a developing roller 15 serving as a developer carrying member is accommodated within a developer accommodating container 12.

The developer accommodating container 12 is formed as a long box shape extending from one end side to the other end side, as shown in FIG. 3. An inner side of the developer accommodating container 12 is divided into two sections including a first accommodating portion 20 and a second accommodating portion 21 by a partition wall 18 formed along a longitudinal direction. Further, the second accommodating portion 21 is positioned diagonally above the first accommodating portion 20. Both end sides of the first accommodating portion 20 and the second accommodating portion 21 are communicated respectively by a first communication portion 22 and a second communication portion 23. Accordingly, the developer accommodated within the developer accommodating container can move in a circulating manner.

The first accommodating portion 20 is provided with a toner density sensor 29 as a means for detecting a toner amount per unit volume. The toner density sensor 29 is a conventionally well-known sensor which outputs a difference of magnetic permeability of the developer (an iron content included in a carrier) as a frequency, and computes a toner density (a weight rate of the toner with respect to the developer).

Further, a developer replenishing port 30 is formed in an end portion close to the second communication portion 23, in the first accommodating portion 20. In other words, the developer replenishing portion 30 is formed in a region (a developer feeding region) in one end side which is away from a circulating path of the developer moving via the second communication portion 23. Further, a new developer is appropriately replenished from a developer replenishing container 42 mentioned below via the developer replenishing port 30.

A developer discharge port 31 is formed in an end portion close to the second communication portion 23, in the second accommodating portion 21. In other words, the developer discharge port 31 is formed in a region (a developer discharge region, preferably a position closest to an end) in one end side which is away from the circulating path of the developer moving via the second communication portion. Further, the developer is discharged via the developer discharge port 31, and a deteriorated carrier is prevented from staying within the developer accommodating container 12 over a long period of time. Further, a flow rate regulating portion 60 is provided in an inlet of the developer discharge region.

Figure 4:
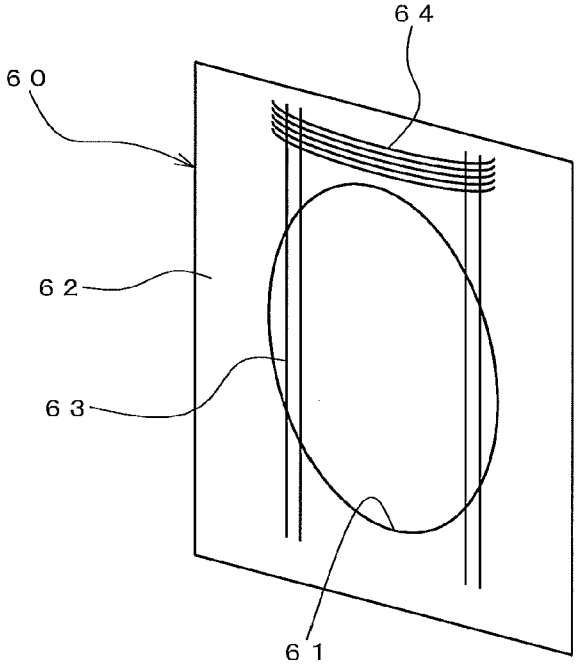
FIG. 4 is a perspective view showing an outline of a flow rate regulating portion in FIG. 3.

The flow rate regulating portion 60 has an opening portion 61 as shown in FIG. 4, and is provided with a flow path restriction portion 62 provided in an inlet of the developer discharge region, and magnetic portions 63 respectively provided in both sides of the opening portion 61. A shape of the opening portion 61 formed in the flow path restriction portion 62 is a circular shape in this case, however, may be the other shape such as an oval shape, a rectangular shape or the like. The flow path restriction portion 62 is arranged between a first blade portion 37 and a second blade portion 38 of a feed screw 14 mentioned below. The magnetic portion 63 is constructed by a plurality of wire rods made of a magnetic material, however, may be constructed by anything which can be magnetized, such as one wire rod or the like. Further, a conductor 64 which is wound like a coil is arranged in an outer periphery in one end side of the magnetic portion 63. Further, if the conductor 64 is excited, it is possible to pick up the carrier in the developer which is going to pass through the opening portion 61 by magnetizing the magnetic portion 63. Accordingly, it is possible to make a substantial opening area of the opening portion 61 small so as to suppress a passing amount of the developer. In other words, since it is impossible to pick up the carrier in the developer by the magnetic portion 63 unless the conductor 64 is excited, the developer passes through at an amount corresponding to the opening area of the opening portion 61. On the other hand, if the conductor 64 is excited, it is possible to pick up the carrier by the magnetic portion 63 so as to stay the developer in the opening portion 61, thereby suppressing the substantial opening area of the opening portion 61. Accordingly, it is possible to suppress the amount of the developer passing through the opening portion 61 in comparison with the case that the conductor 64 is not excited. It is noted that a magnetic force of the magnetic portion 63 may be regulated by changing a winding number of the conductor 64, or a current value applied to the conductor 64. Therefore, it is possible to change a capture amount of the carrier, that is, the developer in the opening portion 61 so as to regulate the substantial opening area.

The agitating screw 13 is structured, as shown in FIG. 3, such that a spiral agitating blade 34 is provided around an agitating side rotating shaft 33, and is arranged within the first accommodating portion 20. The agitating screw 13 is structured such that both end portions of the agitating side rotating shaft 33 are rotatably supported respectively to both end walls constructing the first accommodating portion 20. If the agitating screw 13 rotates, the developer is fed from the second communication portion 23 side to the first communication portion 22 side by the agitating blade 34 while agitating. In this case, an agitating paddle (not shown) may be appropriately formed in an outer peripheral surface of the agitating side rotating shaft 33, thereby forcibly moving the developer from the first accommodating portion 20 to the second accommodating portion 21 via the first communication portion 22.

The feeding screw 14 is structured, as shown in FIG. 3, such that a spiral feeding blade 36 is provided around a feeding side rotating shaft 35. Both end portions of the feeding side rotating shaft 35 are rotatably supported to both end walls constructing the second accommodating portion 21. Further, the feeding blade 36 is constructed by a first blade portion 37, a second blade portion 38 and a third blade portion 39. The first blade portion 37 is formed in such a manner as to be capable of feeding the developer within the second accommodating portion 21 from the first communication portion 22 side to the second communication portion 23 side while agitating, on the basis of a rotation of the feeding side rotating shaft 35, and feeds the developer to the developing roller 15 in the feeding process thereof. The second blade portion 38 is inversely wound to the first blade portion 37, is positioned in an inlet of the developer discharge region going beyond the second communication portion 23, in more detail, a region going beyond the flow path restriction portion 62, and applies a fixed resistance force to the developer heading for the developer discharge port 31 side. Accordingly, the amount of the developer moving while getting over the second blade portion 38 is suppressed, and only a surplus developer is discharged from the developer discharge port 31. A third blade portion 39 has the same winding direction as the first blade portion 37, is arranged within the developer discharge region, and leads the developer getting over the second blade portion to the developer discharge port 31. It is noted that a feed paddle (not shown) may be appropriately formed in an outer peripheral surface of the feed side rotating shaft 35, thereby forcibly moving the developer from the second accommodating portion 21 to the first accommodating portion 20 via the second communication portion 23.

The developing roller 15 is structured, as shown in FIG. 2, such that a plurality of permanent magnets 41 are accommodated within a cylindrical sleeve 40 (in this case, five permanent magnets S2, N2, S1, N1 and S3 are arranged in a clockwise direction in this order). The sleeve 40 is structured such as to rotate in a direction of an arrow in the drawing by a sleeve driving means (not shown).

A developer replenishing container 42 replenishing a replenishing two-component developer (hereinafter, described simply as a developer) constructed by a toner and a carrier is detachably provided, as shown in FIG. 1, above the developing apparatus 10. The developer replenished from the developer replenishing container 42 is structured such as to flow into the first accommodating portion 20 via the developer replenishing port 30 formed in the developer accommodating container 12. It is noted that a toner density of the developer which is previously accommodated in the developer accommodating container 12 is 7%, and a toner density of the developer which is replenished from the developer replenishing container 42 is 80% (a carrier density is 20%, and generally between 10 and 20%).

The cleaning apparatus 11 recovers the toner staying in the surface of the photoreceptor drum 8 after being transferred to the surface so as to clean, as shown in FIG. 1. In this case, a plate-like blade is used as the cleaning apparatus 11, and one end side thereof comes into contact with an outer peripheral surface of a photoreceptor. It is noted that the cleaning apparatus 11 is not limited to the blade, but can use the other cleaning members (for example, a fixed brush, a rotating brush, a roller). Further, it is possible to use a plurality of cleaning apparatuses 11 in conjunction, and it is possible to employ a cleaner less system recovering the un-transferred toner by the developing apparatus 10 in place of the cleaning apparatus 11.

1-2. Transfer Unit 2

The transfer unit 2 is structured, as shown in FIG. 1, such that an intermediate transfer belt 44 is bridged over a pair of support rollers 43, the support rollers 43 are driven by a driving means (not shown), and the intermediate transfer belt 44 is moved in a circulating manner in a direction of an arrow, and is provided with a primary transfer portion 45 and a secondary transfer portion 46.

1-3. Exposure Unit 3

The exposure unit 3 irradiates a laser light to the photoreceptor drum 8, as shown in FIG. 1, and forms an electrostatic latent image corresponding to an image data read by a scanner (not shown). It is possible to use, for example, a laser or a light emitting diode or the like, as the exposure unit 3.

1-4. Fixing Unit 4

The fixing unit 4 is structured such as to rotatably support a fixing roller and a pressurizing roller, although not being illustrated. The fixing roller is made of a conductive material, is rotatably driven by a motor (not shown), and is induction heated by an exciting coil (not shown). The pressurizing roller is brought into pressure contact with the fixing roller, and pinches a recording medium 48. Accordingly, it is possible to fix the toner transferred by the transfer unit 2 to the recording medium 48.

1-5. Paper Feeding Unit 5

The paper feeding unit 5 feeds the recording medium 48 accommodated in a cassette 47 to the secondary transfer portion 46 via a feed roller 49 sequentially, as shown in FIG. 1. The toner image is transferred to the recording medium 48 fed to the secondary transfer portion 46, and the toner image transferred by the fixing unit 4 is fixed, and the recording medium 48 is thereafter carried out to a discharge tray 50.

1-6. Cleaning Unit 6

The cleaning unit 6 can come close to and away from the intermediate transfer belt 44, and recovers the toner staying in the intermediate transfer belt 44 so as to clean by coming close thereto.

1-7. Control Unit 7

Figure 5:
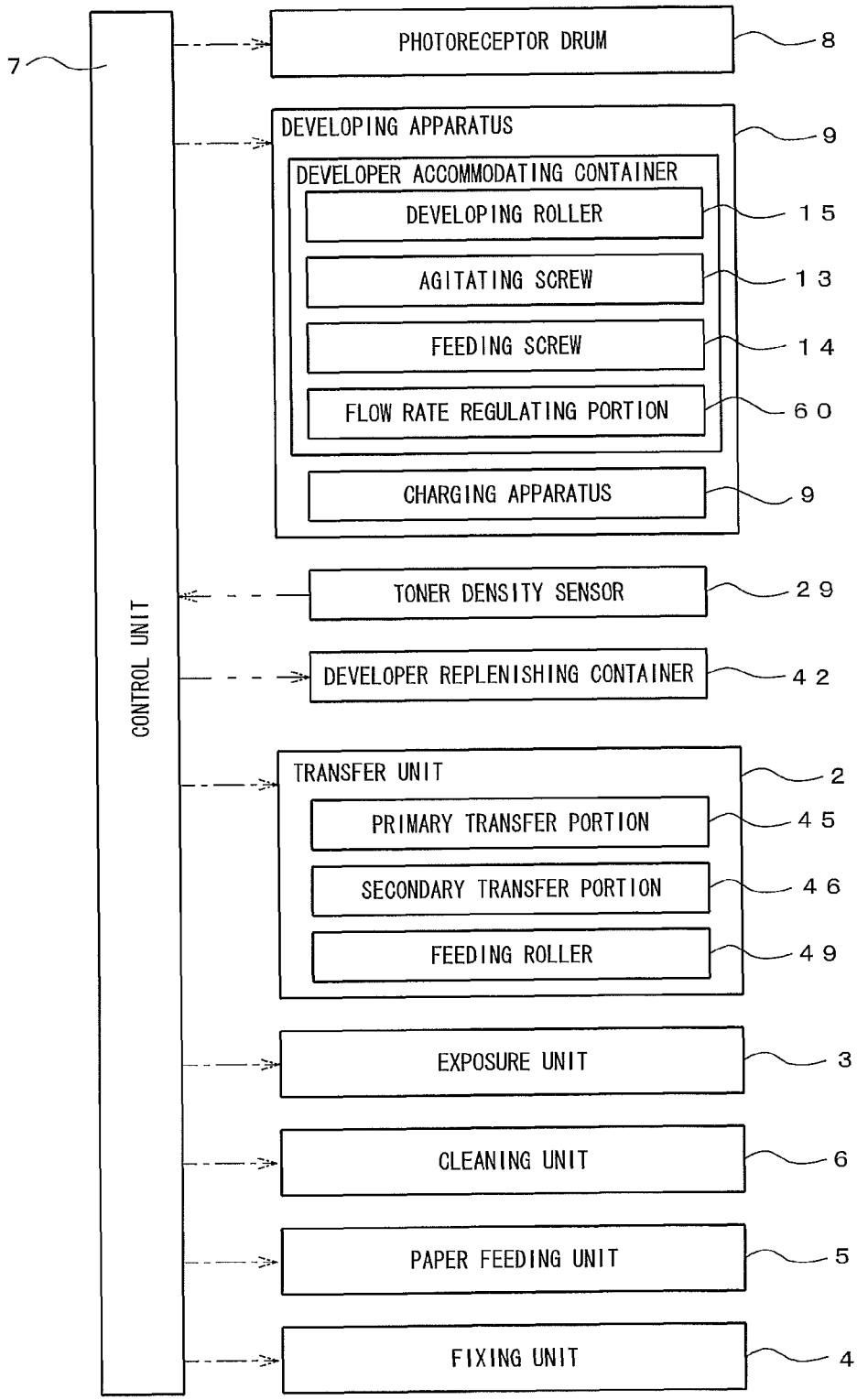
FIG. 5 is a block diagram of the image forming apparatus in accordance with the present embodiment.

The control unit 7 executes an image forming process on the basis of an input signal as shown in FIG. 5. In the image forming process, the agitating screw 13 and the feeding screw 14 are rotatably driven and the developer is circulated while being agitated, although details thereof will be mentioned below. In this process, the toner is fed to the photoreceptor drum 8 via the developing roller 15, and the new developer is appropriately replenished from the developer replenishing container 42 on the basis of the toner density within the developer accommodating container 12 detected by the toner density sensor 29. Further, the deteriorated developer is discharged from the developer accommodating container 12.

2. Whole Motion

Next, a description will be given of a motion of the image forming apparatus having the structure mentioned above.

At a time of forming the image, a color print data obtained by reading the image or an image data output from a personal computer or the like is applied to a predetermined signal process, and is thereafter transmitted as an image signal of each of the colors including yellow (Y), magenta (M), cyan (C) and black (Bk) to each of the image forming units 1.

In each of the image forming units 1, an image latent image is formed by projecting a laser light which is modulated by the image signal onto the photoreceptor drum 8. Further, the toner is fed to the photoreceptor drum 8 from the developing apparatus 10.

In the developing apparatus 10, a developing process is carried out in accordance with the following manner. In other words, the developer accommodated within the developer accommodating container 12 is circulated while being agitated, by rotatably driving the agitating screw 13 and the feeding screw 14. Further, the toner is fed from the feeding screw 14 to the developing roller 15, is scraped off by the regulating member 12*a* so as to be set to a fixed amount, and is thereafter fed to the photoreceptor drum 8. It is noted that details of the developing process will be mentioned later.

Accordingly, the toner images of yellow, magenta, cyan and black are formed respectively on each of the photoreceptor drum 8. The formed toner images of yellow, magenta, cyan and black are sequentially overlapped on the moving intermediate transfer belt 44 so as to be primarily transferred at the primary transfer portion 45. The overlapping toner image formed on the intermediate transfer belt 44 as mentioned above is moved to the secondary transfer portion 46 in accordance with a movement of the intermediate transfer belt 44.

Further, the recording medium 48 is fed from the paper feeding unit 5. The fed recording medium 48 is fed to a portion between the secondary transfer portion 46 and the intermediate transfer belt 44 by the feed roller 49, and the toner image formed in the intermediate transfer belt 44 is transferred thereto. The recording medium 48 to which the toner image is transferred is further fed to the fixing unit 4, where the transferred toner image is fixed, and is thereafter discharged to the discharge tray 50.

2-1. Developing Process

In the developing process, the developer accommodated within the developer accommodating container 12 is moved in a circulating manner while being agitated, by rotatably driving the agitating screw 13 and the feeding screw 14. In this process, the toner is fed to the developing roller 15 by the feeding screw 14.

In other words, in the second accommodating portion 21, the developer is fed from the first communication portion 22 side to the second communication portion 23 side while being agitated, by the first blade portion 37 of the feed screw 14, and is fed to the developing roller 15. If the developer runs into the vicinity of the second communication portion 23, a flow rate of the developer heading for the developer discharge region is regulated by the flow rate regulating portion 60 (a flow rate regulating process). Further, the developer passing through the flow rate regulating portion 60 is exposed to a flow resistance by the inversely wound second blade portion 38. Accordingly, the developer mainly flows to the first accommodating portion 20 via the second communication portion 23. Further, a part of the developer (a surplus developer) gets over the second blade portion 38 so as to run into the developer discharge region. The third blade portion 39 is provided at a position getting over the second blade portion 38, and the developer is agitated and flows in a forward moving direction again, is conducted to the developer discharge port 31 and is discharged to an external portion.

In the first accommodating portion 20, a fact that the toner is consumed is detected by the toner density sensor 29, and the developer is appropriately replenished from the developer replenishing container 42 to the developer accommodating container 12 on the basis of the detection signal. The developer is replenished via the developer replenishing port 30 formed in the first accommodating portion 20.

2-2. Flow Rate Regulating Process

In the flow rate regulating process, the flow path cross sectional area is regulated by the flow rate regulating portion 60 on the basis of a difference of print state.

For example, in the case of printing a lot of images having a high BW ratio (a rate of a print portion (a portion to which a toner is attached) with respect to an output image (which means a case of carrying out 100% print forming only an image portion on a paper, so-called "solid patch" here), a toner amount of consumption is increased, and the carrier is discharged via the developer discharge port 31 in spite that it has a sufficient charging capacity. Accordingly, if the print in which the BW ratio is equal to or more than a predetermined value is continuously carried out at a predetermined number or more, the current application to the conductor 64 wound like the coil is started by the flow rate regulating portion 60 so as to magnetize the magnetic portion 63, thereby sucking and picking up the carrier in the developer which is going to pass through. Accordingly, it is possible to make the developer stay in the opening portion 61 so as to make the substantial opening area small and suppress the amount of the developer passing through the opening portion 61.

As mentioned above, in the developing apparatus 10 provided with the flow rate regulating portion 60, it is possible to regulate the substantial opening area of the opening portion 61 on the basis of whether or not the conductor 64 is excited. Further, it is possible to stabilize the position of the liquid surface in the developer discharge region, by regulating the amount of the developer running into the third blade portion 39. Therefore, it is possible to presume a degree of deterioration of the carrier on the basis of the difference of the BW ratio and the print number at a time of printing so as to appropriately discharge the developer in correspondence to the degree of deterioration of the carrier.

It is noted that since it is possible to regulate the amount of the carrier which can be picked up by the magnetic portion 63, by changing the current value at a time of exciting the conductor 64, it is possible to set the substantial opening area of the opening portion 61 in correspondence to the degree of deterioration of the carrier.

3. Other Embodiment

The present invention is not limited to the structure described in the embodiment mentioned above, but can be variously modified.

In the embodiment mentioned above, the flow rate regulating portion 60 is structured such that the substantial opening area of the opening portion 61 is changed on the basis of whether or not the magnetic portion 63 is excited, however, may be structured as follows such that the opening area is changed directly by an opening and closing member.

3-1. Second Embodiment

Figure 6:
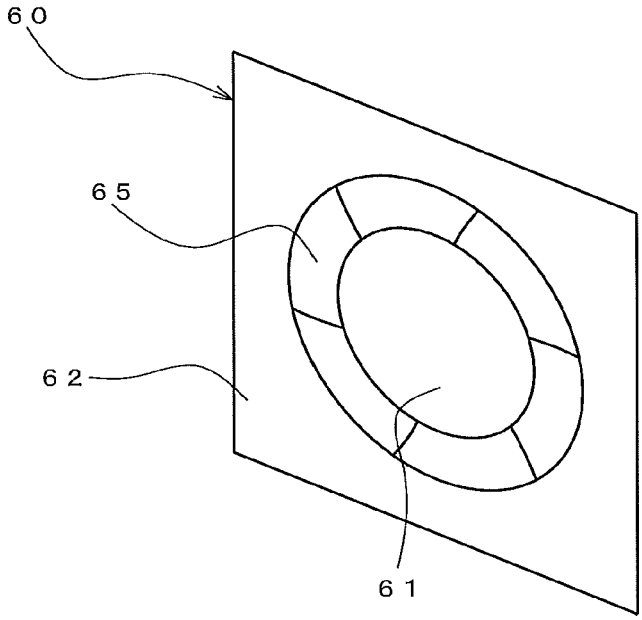
FIG. 6 is a perspective view showing an outline of a flow rate regulating portion in accordance with the other embodiment.

FIG. 6 is structured such that an inner diameter of the opening portion 61 is enlarged or contracted by constructing the flow rate regulating portion 60 by a plurality of diaphragm blades 65 which may be used for a diaphragm for a lens.

In accordance with this structure, it is possible to freely regulate the opening area by the diaphragm blade 65. Accordingly, it is possible to accurately control in comparison with the case that the substantial opening area is regulated by the magnetization. Further, it is possible to correspond not only to the case that the toner amount of consumption is extremely large and it is necessary to suppress the discharge amount of the developer, but also to the case that the carrier is deteriorated and the charging capacity is lowered.

For example, in the case that the opening area is set to a changeable medium value at a normal time, and a great amount of images having a high BW ratio are printed, it is possible to rapidly discharge the deteriorated carrier by setting the opening area to the maximum value. Further, in the case that a great amount of images having a low BW ratio are printed, the toner amount of consumption is reduced, and any new developer is not replenished. Accordingly, the carrier included in the developer within the developer accommodating container 12 moves in a circulating manner while being agitated over a long period of time, and a capacity for charging the toner (a charging capacity) is deteriorated. In this case, the opening area may be set to the minimum value by controlling to drive the diaphragm blade 65. Therefore, it is possible to suppress the amount of the developer discharged from the developer discharge port 31.

3-2. Third Embodiment

Figure 7:
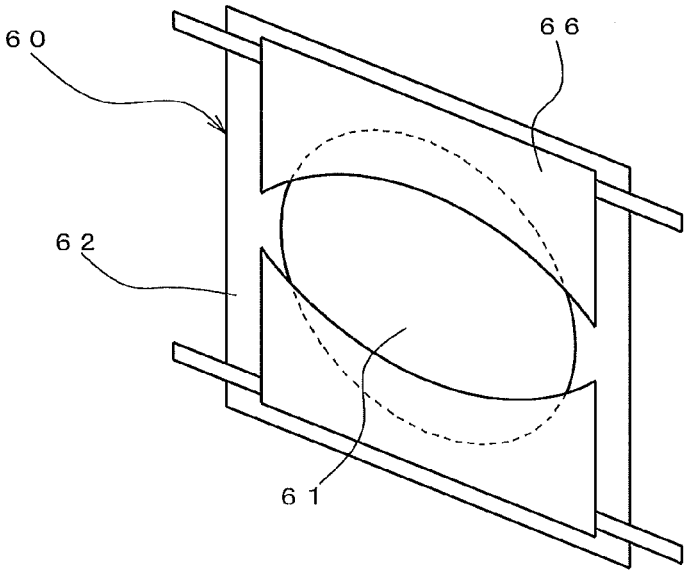
FIG. 7 is a perspective view showing an outline of a flow rate regulating portion in accordance with the other embodiment.

In FIG. 7, the flow rate regulating portion 60 is constructed by two plate members 66 which can come close to and away from each other to open and close the opening portion 61. In other words, a circular arc formed inner edge side is moved forward into the opening portion 61 or moved backward from the opening portion 61. Accordingly, it is possible to regulate the opening area of the opening portion 61. Further, the number of the plate members may be set to one in place of two.

In accordance with this structure, it is possible to simplify the structure so as to manufacture inexpensively in comparison with the case that the diaphragm blade is used.

3-3. Fourth Embodiment

Further, the embodiment mentioned above is structured such as to presume the degree of deterioration of the carrier on the basis of the BW ratio and the print number so as to regulate the opening degree in the flow rate regulating portion 60, however, it is possible to presume a total weight of the developer within the developing apparatus 10 in the following manner and regulate on the basis of a result of presumption.

Figure 9:
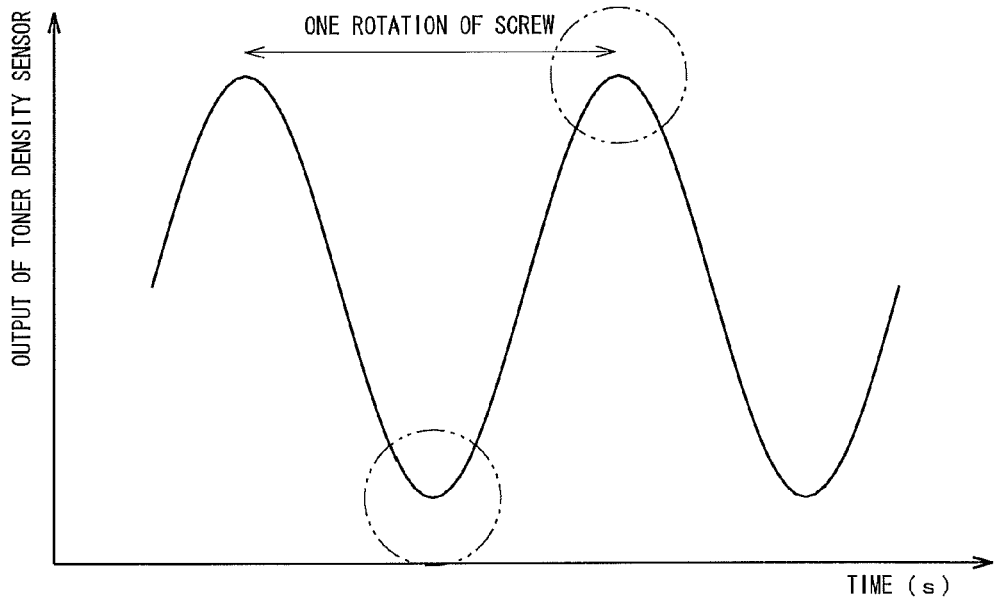
FIG. 9 is a graph showing a change of an output value of the toner density sensor in accordance with a rotation of an agitating screw.
Figure 10A:
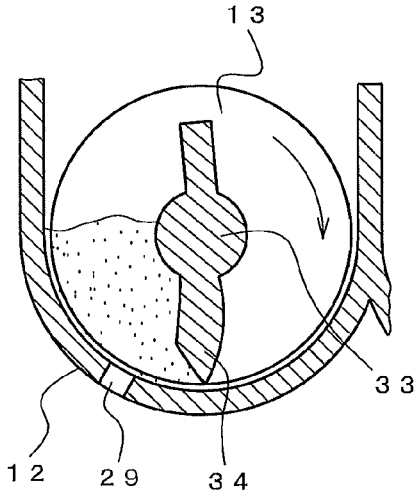
FIGS. 10A and 10B are transversal cross sectional views showing a state of a developer in accordance with the rotation of the agitating screw in the vicinity of the toner density sensor.

In other words, if the print process is started, the detected signal in the toner density sensor 29 is read while synchronously rotating the agitating screw 13 and the feed screw 14. The read detected signal comes to a ripple wave form as shown in FIG. 9 on the basis of the rotation of the agitating screw 13. This is because a detected magnetic permeability periodically changes in accordance with a fluctuation of the weight of the developer within the detection range of the toner density sensor 29 as shown in FIG. 10, on the basis of the rotation of the agitating screw 13.

Figure 8:
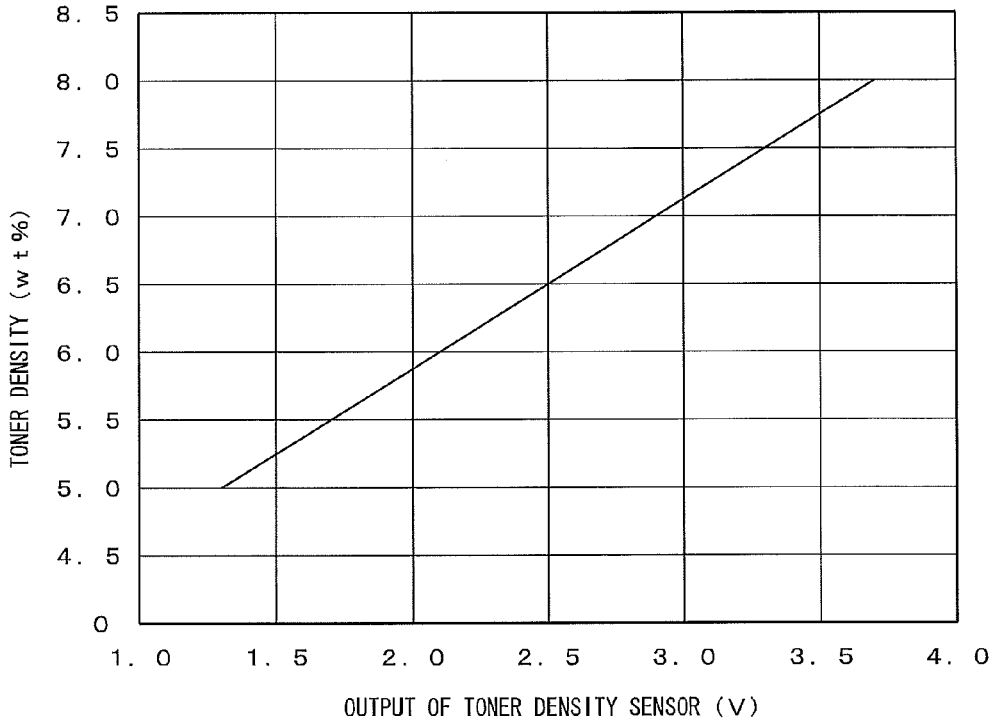
FIG. 8 is a graph showing a relationship between an output of a toner density sensor and a toner density.
Figure 10B:
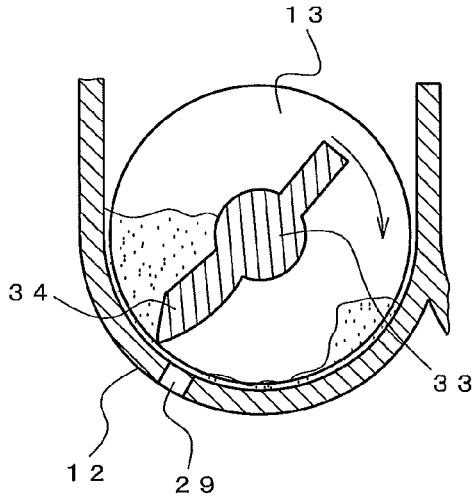

Accordingly, the toner density in accordance with a graph in FIG. 8 is calculated on the basis of a detected value in a state shown in FIG. 10B in which the weight of the developer comes to a minimum value in the detection range. Further, an amplitude (a maximum amplitude) of the signal wave form is calculated from a detected value in a state shown in FIG. 10A in which the weight of the developer comes to a maximum value in the detected range, and the detected value in the state shown in FIG. 10B in which the weight of the developer comes to the minimum value in the detection range, on the basis of the detected signal in the toner density sensor 29.

Subsequently, the weight of the developer in accordance with a data table shown in FIG. 11 is presumed on the basis of the calculated amplitude, and the toner density detected by the toner density sensor 29. In other words, it is determined that the smaller the amplitude becomes, the more the weight of the developer is. This is because it is thought that if the weight of the developer within the developer accommodating container 12 is more, the weight of the developer does not change so much within the detection region of the toner density sensor 29, and the magnetic permeability does not fluctuate so much even by rotating the agitating screw 13. Further, it is determined that the more the amplitude becomes, the less the weight of the developer is. This is because it is thought that if the weight of the developer within the developer accommodating container 12 is less, the weight of the developer within the detection range is apt to change, and the magnetic permeability greatly fluctuates, on the basis of the rotation of the agitating screw 13. Further, it is determined that the lower the toner density is, the more the weight of the developer is. This is because if the weight of the developer within the developer accommodating container 12 is much, the carrier included in the developer is apt to get together in the detection range of the toner density sensor 29, and the toner density within the detection range becomes relatively lower. Further, it is determined that the higher the toner density is, the less the weight of the developer is. This is because it is thought that if the weight of the developer within the developer accommodating container 12 is less, the developer is sufficiently agitated, and the toner density becomes relatively higher. In this case, in FIG. 11, the weight of the developer is segmented into five stages in such a manner that the weight becomes more in the order of weight small 2, weight small 1, reasonable, weight large 1 and weight large 2.

Further, a replenishing amount of the developer is calculated on the basis of a difference between the detected toner density in the toner density sensor 29 and a previously stored target toner density. Further, a replenishing process of replenishing a calculated replenishing amount of developer from the developer replenishing container 42 is started.

Thereafter, if the replenishing process is finished, the opening degree of the opening portion 61 is regulated by controlling to drive the flow rate regulating portion 60 in correspondence to a level of the presumed weight of the developer. In this case, since the weight of the developer is presumed in five stages, the opening degree is structured such as to be regulated in five stages including a case that the opening portion 61 of the flow rate regulating portion 60 is fully opened and a case that it is fully closed.

3-4. Fifth Embodiment

Further, in the embodiment mentioned above, the weight of the developer within the developer accommodating container 12 is presumed on the basis of the amplitude of the signal wave form input from the toner density sensor 29 and the toner density, however, may be presumed in the following manner.

For example, the weight of the developer within the developer accommodating container 12 may be presumed in accordance with a data table in FIG. 12, on the basis of a fluctuation ratio of a cycle of the signal wave form input from the toner density sensor 29, and the toner density. In other words, if the weight of the developer within the developer accommodating container 12 is increased, the load applied to the agitating screw 13 becomes large, and the rotating speed is lowered. Accordingly, the cycle of the signal wave form output from the toner density sensor 29 becomes longer (the fluctuation ratio becomes larger (becomes plus)). On the other hand, if the weight of the developer within the developer accommodating container 12 is reduced, the load applied to the agitating screw 13 becomes small, and the rotating speed is increased. Therefore, the cycle of the signal wave form output from the toner density sensor 29 becomes shorter (the fluctuation ratio becomes smaller (becomes minus)). Accordingly, the weight of the developer within the developer accommodating container 12 may be presumed in accordance with the data table in FIG. 10, on the basis of the fluctuation ratio of the cycle of the signal wave form, and the detected toner density.

3-5. Sixth Embodiment

Further, the structure may be made such that a pressure sensor (not shown) is provided in addition to the toner density sensor 29, a pressure directly applied from the developer within the developer accommodating container 12 is detected by the pressure sensor, and the weight of the developer within the developer accommodating container 12 is presumed in accordance with a data table in FIG. 13, on the basis of a result of detection.

3-6. Seventh Embodiment

Further, each of the embodiments mentioned above is structured such that the weight of the developer is presumed on the basis of the amplitude or the cycle of the signal wave form input from the toner density sensor 29, and the toner density, however, the weight of the developer may be presumed only from the amplitude of the signal wave form, only from the cycle or only from the pressure, although a precision is somewhat low.

What is claimed is:

1. A developing apparatus comprising:

a developer carrying member;

a developer accommodating container extending from one end to the other end along said developer carrying member, and in which developer is accommodated;

a first feeding member provided within said developer accommodating container and feeding the accommodated developer while agitating; and a second feeding member provided within said developer accommodating container and feeding the developer to said developer carrying member, wherein said developer accommodating container comprises:

a first accommodating portion in which said first feeding member is arranged;

a second accommodating portion in which said second feeding member is arranged;

a first communication portion communicating said first accommodating portion and said second accommodating portion in one end side;

a second communication portion communicating said first accommodating portion and said second accommodating portion;

a developer replenishing portion arranged away from said second communication portion, in the other end side of said first accommodating portion;

a developer discharge portion arranged in the other end away from said second communication portion, in the other end side of said second accommodating portion; and a flow rate regulating portion comprising a changeable opening portion and being arranged between said second communication portion and the developer discharge portion, and regulating an amount of the developer passing through the opening portion by changing a cross sectional area of the opening portion.

2. The developing apparatus as claimed in claim 1, wherein said flow rate regulating portion is constructed by a magnetic material capable of picking up the developer which is magnetized by a current application.

3. The developing apparatus as claimed in claim 1, further comprising:

a developer weight presuming means for presuming a weight of the developer within said developer accommodating container; and a flow rate control means for regulating an amount of the passing developer by controlling to drive said flow rate regulating portion on the basis of the weight of the developer presumed by said developer weight presuming means.

4. A developing apparatus comprising:

a developer carrying member;

a developer accommodating container extending from one end to the other end along said developer carrying member, and in which developer is accommodated;

a first feeding member provided within said developer accommodating container and feeding the accommodated developer while agitating; and a second feeding member provided within said developer accommodating container and feeding the developer to said developer carrying member, wherein said developer accommodating container comprises:

a first accommodating portion in which said first feeding member is arranged;

a second accommodating portion in which said second feeding member is arranged;

a first communication portion communicating said first accommodating portion and said second accommodating portion in one end side;

a second communication portion communicating said first accommodating portion and said second accommodating portion;

a developer replenishing portion arranged away from said second communication portion, in the other end side of said first accommodating portion;

a developer discharge portion arranged in the other end away from said second communication portion, in the other end side of said second accommodating portion; and a flow rate regulating portion arranged between said second communication portion and the developer discharge portion, and regulating an amount of the passing developer, wherein said second feeding member comprises a rotating shaft and is provided with a spiral blade portion in the periphery of the rotating shaft, wherein said blade portion comprises:

a first blade portion feeding the developer from the first communication portion side to the second communication portion side while agitating on the basis of a rotation;

a second blade portion applying an inverted resistance to the developer fed by said first blade portion; and a third blade portion leading the developer getting over the second blade portion to the developer discharge portion, and wherein said flow rate regulating portion is capable of expanding and contracting an opening region between an inner wall side constructing the second accommodating portion and the periphery of the rotating shaft of the second feeding member where said blade portion is not positioned.

5. An image forming apparatus comprising the developing apparatus as claimed in claim 1.

6. The developing apparatus as claimed in claim 1, wherein the flow rate regulating portion comprises at least one magnetic wire rod operable to pick up developer when the at least one magnetic wire rod is magnetized.

7. The developing apparatus as claimed in claim 6, wherein the flow rate regulating portion comprises a plurality of magnetic wire rods.

8. The developing apparatus as claimed in claim 6, wherein the at least one wire rod is disposed at least partially inside the opening portion to at least partially obstruct the opening portion.

9. The developing apparatus as claimed in claim 8, wherein the picked-up developer decreases the cross sectional area of the opening portion.

10. A developing apparatus comprising:

a developer accommodating container in which developer is accommodated;

a feeding member provided within the developer accommodating container and feeding the accommodated developer while agitating, the second feeding member comprising a rotating shaft and a spiral blade portion on the periphery of the rotating shaft; and wherein the developer accommodating container comprises:

an accommodating portion in which the feeding member is arranged;

a developer discharge portion in the accommodating portion; and a flow rate regulating portion regulating an amount of the passing developer, wherein the flow rate regulating portion is capable of expanding and contracting an opening region between an inner wall side constructing the accommodating portion and the periphery of the rotating shaft of the feeding member where the blade portion is not positioned.

11. An image forming apparatus comprising the developing apparatus as claimed in claim 10.

* * * * *